United States Patent [19]

Reece et al.

[11] Patent Number: 4,580,581

[45] Date of Patent: Apr. 8, 1986

[54] SELF DEODORIZING ASH TRAY

[76] Inventors: Everett E. Reece; Sherrian L. Reece, both of 2838 Schnell School Road #2, Placerville, Calif. 95667

[21] Appl. No.: 588,239

[22] Filed: Mar. 12, 1984

[51] Int. Cl.[4] ..... A24F 19/02

[52] U.S. Cl. ..... 131/231; 239/60; 239/289; 428/35; 428/905

[58] Field of Search ..... D27/8, 27; 131/231, 131/238, 240 R; 239/34, 57, 60, 59, 289; 428/13, 905, 35

[56] References Cited

U.S. PATENT DOCUMENTS

| | | | |
|---|---|---|---|
| 2,337,409 | 12/1943 | Penn | 131/238 X |
| 2,464,826 | 3/1949 | Neher et al. | 428/501 |
| 2,577,320 | 12/1951 | Fenyo | 428/905 X |
| 2,603,532 | 7/1952 | Wheeler et al. | 239/59 |
| 2,642,310 | 6/1953 | Meek et al. | 239/35 |
| 2,681,827 | 6/1954 | Racz | 239/57 |
| 2,718,432 | 9/1955 | Hudachek | 239/57 |
| 2,779,624 | 1/1957 | Friedman | 131/231 X |
| 3,654,045 | 4/1972 | Kahn | 428/542.2 |
| 3,915,664 | 10/1975 | Busch et al. | 428/460 X |
| 4,154,398 | 5/1979 | Gualandi | 239/59 |
| 4,267,229 | 5/1981 | Knight et al. | 428/324 |
| 4,272,385 | 6/1981 | Crete et al. | 428/921 X |
| 4,297,233 | 10/1981 | Gualandi | 502/401 |
| 4,409,275 | 10/1983 | Samowich | 428/138 |
| 4,476,171 | 10/1984 | Takeuchi | 428/38 |
| 4,493,011 | 1/1985 | Spector | 428/905 X |

OTHER PUBLICATIONS

Page 152 of Webster's Seventh New Collegiate Dictionary and the Title Page and the verso of the Title Page. G&C Merriam Co., Publishers, Springfield, Mass.

*Primary Examiner*—Henry F. Epstein

*Attorney, Agent, or Firm*—L. S. Van Landingham, Jr.

[57] ABSTRACT

The present disclosure is concerned with a deodorizing and fragrance releasing insert for an ash tray, and with an ash tray provided with the insert. In a further embodiment, the disclosure is concerned with a self-deodorizing and fragrance releasing ash tray which is constructed from a composite material including a synthetic resin and a compatible fragrant volatile odor releasing substance.

30 Claims, 12 Drawing Figures

SELF DEODORIZING ASH TRAY

THE BACKGROUND OF THE INVENTION

1. The Field of the Invention

The present invention relates to a deodorizing and fragrance releasing insert for an ash tray. In a second embodiment, the invention is concerned with an ash tray which includes the insert of the invention. In a further embodiment, the invention is concerned with self deodorizing and fragrance releasing ash trays which are constructed from a composite material including a synthetic resin and a compatible fragrant volatile odor releasing substance.

2. The Prior Art

The need for eliminating or masking the noxious odors from cigars and cigarettes has long been recognized in the prior art, and numerous attempts at modifying ash trays have been made in an attempt to eliminate or mask the noxious odors. U.S. Pat. Nos. 2,603,532, 2,642,310 and 4,154,398 all disclose ash trays mounted above a cake of deodorizing gel material and means to physically vary the amount of the gel that is in contact with the ambient air. U.S. Pat. No. 2,681,827 discloses the use of a receptacle resting within the bowl of the ash tray which houses several cakes of deodorizing gel, while U.S. Pat. No. 2,718,432 also discloses a solid deodorant that rests within the bowl of an ash tray. U.S. Pat. No. 2,779,624 also discloses a self-deodorizing ash tray, wherein the bottom surface of the ash tray is impregnated with a pleasant odor-releasing composition. U.S. Pat. No. 4,297,233 teaches the use of a granular material having absorbed therein an oily vapor diffuser substance which is placed within the bowl of an ash tray for gradually releasing the deodorizing substance into the surrounding environment, without being influenced by the locally high temperatures produced by the glowing fire of the cigarettes.

THE SUMMARY OF THE INVENTION

The present invention overcomes the disadvantages and deficiencies of the prior art. In one embodiment, the present invention provides a deodorizing and fragrance releasing insert for an ash tray. If desired, the ash tray may be of the usual type commonly used for receiving refuse from partially and completely combusted combustible tobacco products, and it may have a refuse receiving surface which is also useful for extinguishing burning combustible tobacco products. The insert is constructed from a deodorizing and fragrance releasing composite material consisting essentially of a major proportion by weight of fire resistant synthetic resin and an effective but minor proportion by weight of a compatible fragrant volatile odor releasing substance. The insert may have the general configuration of the refuse receiving surface, and it may be of a size and shape to rest thereon and cover the refuse receiving surface. The composite material has sufficient fire resistance to permit burning combustible tobacco products to be extinguished thereon without igniting. The composite material is capable of removing obnoxious odors from burning combustible tobacco products extinguished thereon and from completely and partially combusted combustible tobacco products deposited thereon. The composite material is also capable under normal conditions of use of the ash tray of releasing fragrance from the volatile odor releasing substance whereby obnoxious odors are removed and replaced with a pleasing fragrance.

In a second embodiment of the invention, a self deodorizing and fragrance releasing ash tray is provided which includes the aforementioned insert of the invention as an essential component thereof. In still a further embodiment of the invention, a self deodorizing and fragrance releasing ash tray is provided which is constructed from the aforementioned composite material. Thus, the ash tray so constructed is capable of removing obnoxious odors from burning combustible tobacco products extinguished thereon and from completely and partially combusted combustible tobacco products deposited thereon. It is also capable under normal conditions of use of releasing fragrance from the volatile odor releasing substance whereby obnoxious odors are removed and replaced with a pleasing fragrance.

THE DETAILED DESCRIPTION OF THE INVENTION INCLUDING THE PRESENTLY PREFERRED EMBODIMENTS THEREOF

FIGS. 1–10 of the drawings illustrate certain presently preferred embodiments of the invention. As will be recognized by those skilled in this art, modifications may be made in these specifically disclosed embodiments in the light of the following disclosure without departing from the spirit or scope of the invention.

Figure 3:
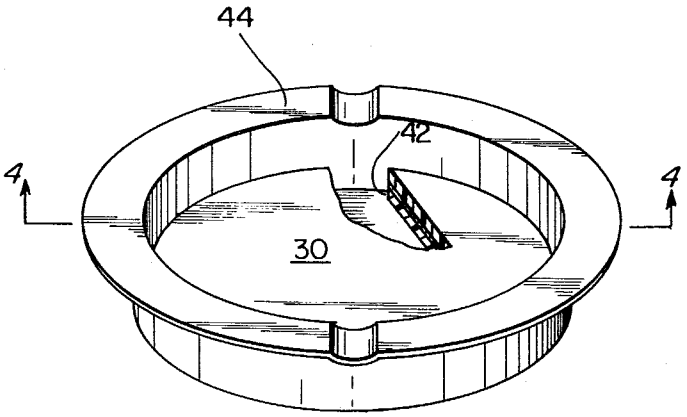
FIG. 3 is a perspective view of a conventional ash tray having the laminate material of FIG. 1 placed therein upon the refuse-receiving surface.
Figure 4:
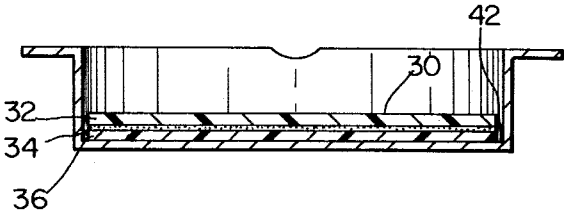
FIG. 4 is a sectional view of the ash tray of FIG. 3 taken along line 4—4.
Figure 1:
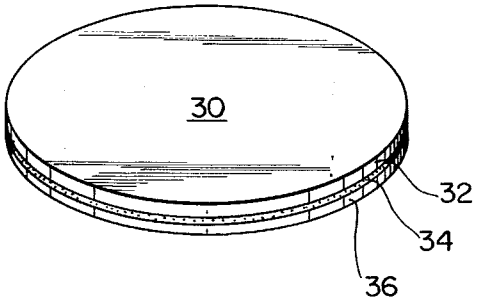
FIG. 1 is a perspective view of the laminate material of the invention in the form of a disk.
Figure 2:
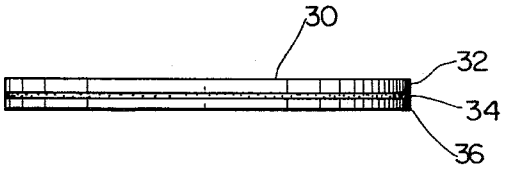
FIG. 2 is a side view of the laminate material of FIG. 1.
Figure 9:
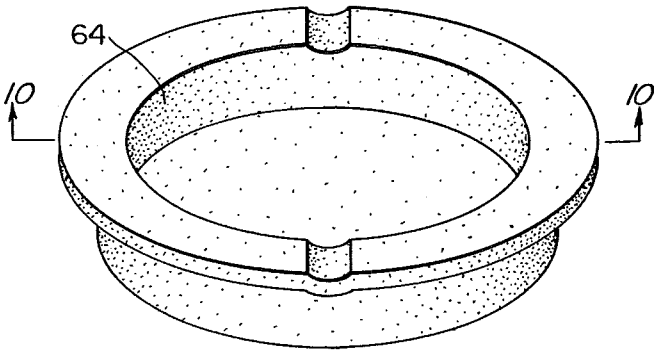
FIG. 9 is a perspective view of an ash tray made from the mixture of synthetic resin and odor-releasing substance of the invention.
Figure 10:
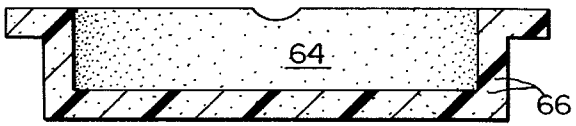
FIG. 10 is a sectional view of the ash tray of FIG. 9 taken along the line 10—10.
Figure 7:
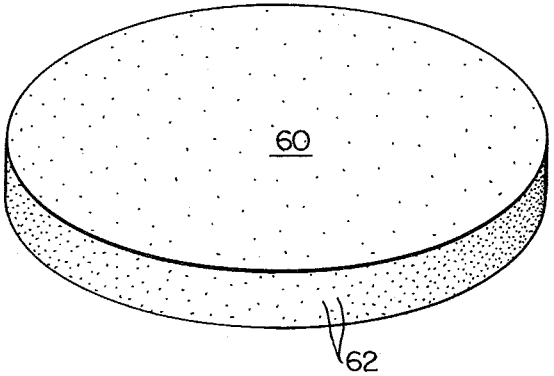
FIG. 7 is a perspective view of a mixture of synthetic resin and odor-releasing substance in a second embodiment of the invention in the form of a disk.
Figure 8:
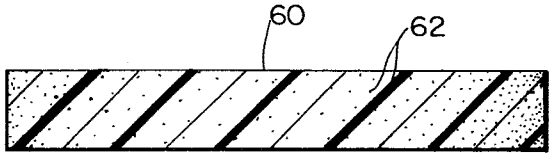
FIG. 8 is a cross-sectional view of the mixture of FIG. 7.

Referring now to FIGS. 1–4, 7 and 8, the deodorizing and fragrance releasing insert of the invention for a prior art ash tray is constructed from a composite material which consists essentially of a major proportion by weight of fire resistant synthetic resin and an effective but minor proportion by weight of a compatible fragrant volatile odor releasing substance. The insert may be in the form of the laminate of disk 30, or in the form of the substantially uniform admixture of disk 60. The disks 30 and 60 conform roughly in shape to the refuse receiving surface 42 of the conventional ash tray 44, and preferably are slightly smaller so that they will fit easily within the walls of ash tray 44 and rest upon the refuse receiving surface 42. While disk 30 is shown in FIGS. 3 and 4 in place within ash tray 44, it is understood that disk 60 may be substituted therefor when desired.

The composite material used in preparing disks 30 and 60 has sufficient fire resistance to permit burning combustible tobacco products, such as cigars, cigarettes and pipe tobacco, to be extinguished on disks 30 and 60 without igniting them or otherwise causing a fire hazzard. The composite material in disks 30 and 60 is capable of removing obnoxious odors from burning combustible tobacco products that are extinguished thereon, and also from completely and/or partially combusted combustible tobacco products that are deposited thereon in the normal use of the ash tray. The composite material in disks 30 and 60 is additionally capable, under normal conditions of use of the ash tray 44 with a disk 30 or 60 inserted therein, of releasing fragrance from the volatile odor releasing substance contained therein. Thus, when the disk 30 or 60 is in place in ash tray 44, the obnoxious odors normally associated with prior art ash trays are both removed and replaced with a pleasing fragrance.

The composite material in disks 30 and 60 has the further important advantage of increasing in effectiveness as its temperature increases. For example, when no recently extinguished tobacco product is resting on disk 30 or 60 and the temperature thereof approaches ambient temperature, then a relatively small amount of fragrance is released from the composite material. However, when the temperature of disk 30 or 60 is increased markedly by extinguishing a burning tobacco product thereon, then the amount of fragrance that is released is also increased markedly. Similarly, the rate of removal of obnoxious odors is increased markedly with an increase in temperature of disk 30 or 60. The foregoing is of importance in the environment of the invention as the rate of formation of obnoxious odors from burning tobacco products increases substantially during the extinguishing step.

FIGS. 5, 6, 9 and 10 of the drawings illustrate ash trays 50 and 64 that are prepared entirely from the aforementioned composite material of the invention. In ash tray 50, the composite material is in the form of a laminate similar to that of disk 30, and in ash tray 64, the composite material is in the form of the substantially uniform admixture of disk 60. The ash trays 50 and 64 may be used as previously described for ash tray 44 with the disk 30 or 60 in place therein, and they have the deodorizing and fragrance releasing properties and advantages that were previously described for ash tray 44. In addition, they have the further advantage of providing an entire surface area that is composed of the composite material and thus are even more effective.

The laminates used in preparing disk 30 and ash tray 50 are of similar construction and may be prepared by the processes described hereinafter in connection with FIGS. 11 and 12. The laminates of disk 30 and ash tray 50 each have respectively (1) upper first layers 32 and 52 of synthetic resin, (2) intermediate second layers 34 and 54 of a bonding or laminating agent which contain the fragrant volatile odor releasing substance, or alternatively, a preformed plastic film such as cellulose acetate film which has the odor releasing substance incorporated therein, and (3) lower third layers 36 and 56 of synthetic resin. In the presently preferred embodiment, the upper first layers 32 and 52 have a thickness of about 3/32 inch, the intermediate second layers 34 and 54 have a thickness of about 1/32 inch, the lower third layers 36 and 56 have a thickness of about 2/32 inch, and the overall thickness of the laminates is about 3/16 inch. However, each of these thicknesses may be varied markedly, such as from 5% to 500% of the recited values, or from 10% to 200% of the recited values.

Figure 11:
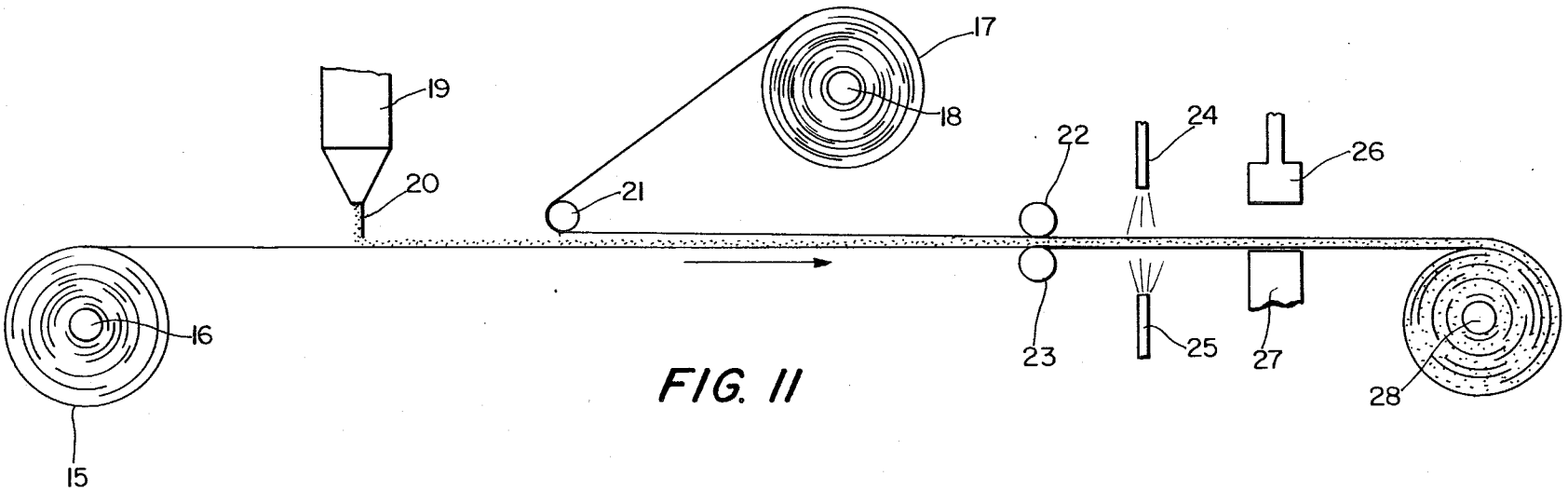
FIG. 11 is a schematic representation of a first production process for obtaining the laminate material of the invention.

FIG. 11 of the drawings schematically illustrates one suitable process for forming a laminate for use in practicing the present invention. Referring now to FIG. 11, rolls 15 and 17 of synthetic resin sheet in the desired thicknesses may be obtained from conventional sources and placed on rollers 16 and 18, respectively. The resin sheets from roll 15 is fed beneath dispenser 19 and doctor blade 20, beneath roller 21, between heated rolls 22 and 23, between air jets 24 and 25, between stamp 26 and strike plate 27, and then to roller 28. The resin sheet from roll 17 is fed around roller 21, between heated rolls 22 and 23, between air jets 24 and 25, between stamp 26 and strike plate 27, and then to roller 28. Dispenser 19 contains a mixture of the bonding agent and fragrant odor releasing compound which has been stirred sufficiently to form a uniform mixture. In operation, the roller 28 is rotated by means not shown in the drawing in the interest of clarity, and pulls the resin sheets from rolls 15 and 17 through the production apparatus. Dispenser 19 deposits a uniform layer of the mixture of bonding agent and odor releasing compound over the entire upper surface of the resin sheet from roll 15. Any excess amount of the mixture is removed by doctor blade 20. The resin sheet from roll 17 passes around roller 21 and is adjacent the layer of mixture fed from dispenser 19. The three layers are then passed through heated rolls 22 and 23 where the layers are compressed and heated to produce a strong bond between the layers. The laminate material thus formed is then passed between the air jets 24 and 25 which cool the laminate. The cooled laminate is then passed between the stamp 26 and strike plate 27. The stamp 26 oscillates periodically and strikes the laminate as it passes over strike plate 27 to thereby produce a plurality of blanks of the desired shape and size. The waste laminate material is then wound around roller 28 while the desired blanks are removed by means not shown in the interest of clarity for later use.

Figure 12:
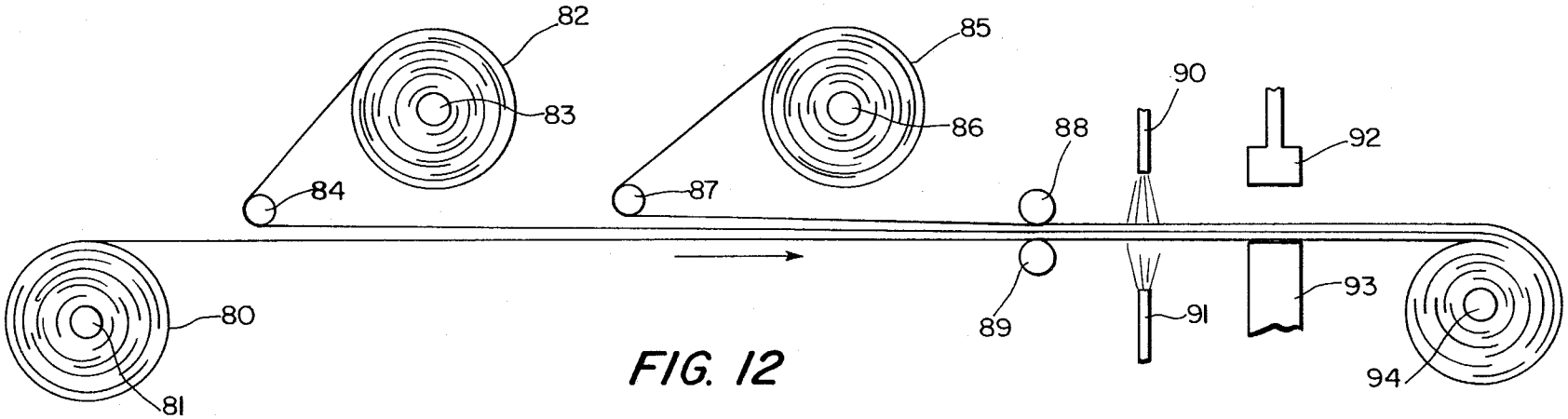
FIG. 12 is a schematic representation of a second production process for obtaining the laminate material of the invention.

A laminate useful in practicing the invention may also be formed following the process shown schematically in FIG. 12 of the drawings. Referring now to FIG. 12, synthetic resin sheets 80 and 85 having desired thicknesses and obtained from conventional sources are placed on rollers 81 and 86, respectively. Cellulose acetate film 82 having incorporated therein an odor releasing compound is placed on roller 83. The resin sheet from roll 80 is fed between heated rolls 88 and 89, between air jets 90 and 91, between stamp 92 and strike plate 93, and then to roller 94. The cellulose acetate film 82 is fed around roller 84, between heated rolls 88 and 89, between air jets 90 and 91, between stamp 92 and strike plate 93, and then to roller 94. The resin sheet 85 is fed around roller 87, between heated rolls 88 and 89, between air jets 90 and 91, between stamp 92 and strike plate 93, and then to roller 94. The cellulose acetate film 82 having the odor releasing compound therein is thus layered between the resin sheets 80 and 85. In operation, the roller 94 is rotated by a conventional means not shown in the interest of clarity, and the sheets 80, 82 and 85 are pulled through the apparatus. The three sheets 80, 82 and 85 pass between heated rolls 88 and 89 where the layers are compressed and heated to produce a strong bond between the layers. The laminate material thus formed is then passed between air jets 90 and 91 to remove excess heat, and the laminate material is then passed between stamp 92 and strike plate 93. The stamp 92 oscillates periodically and strikes the laminate material to produce a plurality of blanks having the desired shape and size. The waste laminate material is wound around roller 94 while the desired blanks (not shown in the interest of clarity) are removed for later use.

In practicing one presently preferred variant of the invention, the laminate material is stamped to form a shape which conforms approximately to the refuse receiving surface of a conventional ash tray. Since many prior art ash trays have a round refuse receiving surface approximately 2.5–3 inches in diameter, the stamped laminate material for use therewith is preferably in the shape of disc 30 and the diameter thereof corresponds closely with the refuse receiving surface. However, in instances where the refuse receiving surface has a configuration other than round, then it is understood that the stamped shape is varied in configuration to closely conform thereto. As may be noted from FIGS. 1–4 of the drawings, the disc 30 has a first layer 32 of synthetic resin sheet, an intermediate layer 34 of a bonding agent and odor releasing compound, or alterntively, a cellulose acetate film having an odor releasing compound incorporated therein, and second synthetic resin sheet 36.

As may be noted from FIGS. 1–4, the disc 30 is made to conform roughly in size and shape to the refuse receiving surface 42 of a conventional ash tray 44, and it may be slightly smaller in diameter so that it will fit easily within the walls of ash tray 44 and rest upon the refuse receiving surface 42. When an ignited or recently extinguished combustible tobacco product such as a cigar or cigarette is not resting against the disc 30, then only a relatively small amount of the odor releasing compound is volatilized from disc 30. However, when hot ashes or an ignited or recently extinguished combustible tobacco product rests against layer 32, then a relatively large amount of the odor releasing compound is volatilized. Thus, the composite material in disc 30 is capable under normal conditions of use of the ash tray of removing obnoxious odors from burning combustible tobacco products extinguished thereon, and from completely and partially combusted combustible products deposited thereon, and also is capable of releasing fragrance from the volatile odor releasing substance whereby the obnoxious odors are removed and replaced with a pleasing fragrance.

The laminate disk 30 may be obtained directly from the stamping step in the processes of FIGS. 11 and 12. The diameter may vary depending upon the size of the prior art ash tray, but is usually about 2.5 to 3 inches. The configuration is not always circular, and both the size and shape may be varied as required for a given ash tray.

Figure 5:
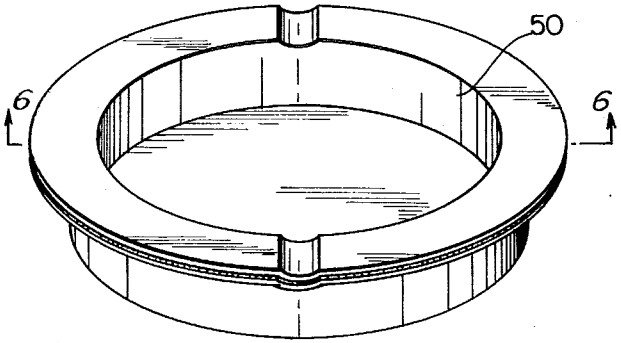
FIG. 5 is a perspective view of an ash tray made from the laminate material of the invention.
Figure 6:
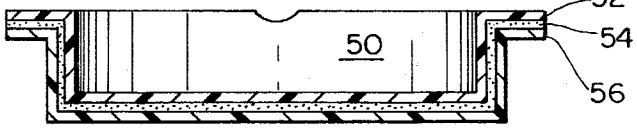
FIG. 6 is a sectional view of the ash tray of FIG. 5 taken along the line 6—6.

In the embodiment shown in FIGS. 5 and 6, an entire ash tray may be molded from the laminate material. A flat blank of the laminate material may be obtained from the production process and placed in a press mold. The laminate material is sufficiently pliable so that the blank will conform to the surfaces of the press mold, and will retain the shape of the mold. An ash tray 50 thus obtained will be comprised of a first layer 52, a middle layer 54, and an outer layer 56.

In an alternative embodiment of the invention shown in FIGS. 7–10, the odor releasing substance is admixed directly with the synthetic resin until a substantially uniform admixture is obtained. Usually, the odor releasing substance is mixed with synthetic resin pellets following prior art techniques to produce a composite material having the odor releasing substance uniformly distributed within the product. In the embodiment shown in FIGS. 7 and 8, the mixture of synthetic resin and odor releasing substance 62 is formed into a disk 60 for insertion onto the refuse receiving surface 42 of a conventional ash tray 44. The disk 60 may be formed in a mold, by an extrusion process, or open cast, or closed cast, or stamped from a larger sheet of the material. In the embodiment shown in FIGS. 9 and 10, an entire ash tray 64 is made from the mixture of synthetic resin and odor releasing substance. The mixture may be molded in a mold or extrusion molded, or open cast, or closed cast, to form the ash tray 64. Alternatively, a blank may be stamped from a previously formed sheet of the mixture and, since the blank is pliable, the blank may be put in a press mold and caused to conform to the shape of the mold to form the ash tray 64. The ash tray 64 will consist of the synthetic resin having uniformly distributed therein odor releasing substance 66.

The synthetic resin component of the composite material used in practicing the invention is preferably an acrylic resin. Acrylic resins are well known and are an art-recognized and commercially available group of resins. They are defined, for example, in the authoritative text *The Condensed Chemical Dictionary,* published by Van Nostrand Reinhold Company, New York, N.Y. the definition of which is incorporated herein by reference. The polyacrylates and polymethacrylates may be used, and especially the resinous polymers of methyl acrylate and methyl methacrylate. Other classes of synthetic resins include the polyolefin resins such as polyethylene and polypropylene, copolymers of two or more ethylenically unsaturated compounds such as butadiene-styrene copolymers, cellulose acetate, polyethylene acetate and polyvinyl acetate. It is understood that still other classes of suitable synthetic resins may be used, and that mixture of one or more of the above or other suitable synthetic resins may be used.

The fragrant volatile odor releasing substance used as a component of the composite material of the invention is compatible with the synthetic resin component. Such substances are art-recognized and are commercially available, and include, for example, essential oils and essences, perfumes and perfume bases. Some examples of essential oils include spearmint oil, citronella, peppermint oil, sandlewood oil, cedarwood oil, bayberry oil, pine oil and floral and fruit fragrances in general such as rose oil, jasmine oil, orange oil, lemon oil and lime oil. It is understood that mixtures of one or more of such substances may be used. A mixture containing about 50–70% by weight of spearmint oil and about 50–30% by weight of citronella is especially useful.

The bonding agent component of layer 34 or 54 may be any suitable prior art recognized material for this purpose, or for use as bonding agents, glues and adhesives in preparing laminates in general. Plasticizers for the selected synthetic resin or triacetin may be used in some instances. It is also possible to use a preformed plastic sheet having the odor releasing substance incorporated therein which serves as a bonding material, such as a preformed cellulose acetate sheet which contains the odor releasing substance.

The synthetic resin is sufficiently fire resistant under the conditions of use of the ash tray to avoid a fire hazzard when ignited tobacco products are extinguished thereon. The ratio of odor releasing substance to synthetic resin may vary over wide ranges. The synthetic resin is present in a major proportion by weight, and the odor releasing substance is present in a minor but effective proportion by weight to produce an odor reducing and fragrance releasing composite material. In one variant, the composite material may contain, for example, about 1–25% by weight of the odor releasing substance and about 99–75% of the synthetic resin. In another variant, the respective percentages by weight within these broad ranges may be about 10–15% or about 12% of the odor releasing substance and about 85–90%, or about 88%, of the synthetic resin.

The foregoing detailed discussion and the accompanying drawings are for purposes of illustration only, and are not intended as being limiting to the spirit or scope of the appended claims. It is understood that equivalent structures may be substituted for those specifically disclosed herein, and that equivalent materials of construction may be employed in addition to those specifically mentioned.

We claim:

1. A deodorizing and fragrance releasing insert for an ash tray, the ash tray being useful for receiving refuse from partially and completely combusted combustible tobacco products and having a refuse receiving surface which is also useful for extinguishing burning combustible tobacco products, the insert being constructed from a deodorizing and fragrance releasing composite material consisting essentially of a major proportion by weight of fire resistant synthetic resin and an effective but minor proportion by weight of a compatible fragrant volatile odor releasing substance, the insert having the general configuration of said refuse receiving surface and being of a size and shape to rest thereon and cover the said refuse receiving surface, the said composite material having sufficient fire resistance to permit burning combustible tobacco products to be extinguished thereon without igniting, the composite material being capable of removing obnoxious odors from burning combustible tobacco products extinguished thereon and from completely and partially combusted combustible tobacco products deposited thereon, and the composite material also being capable under normal conditions of use of the ash tray of releasing fragrance from said volatile odor releasing substance whereby said obnoxious odors are removed and replaced with a pleasing fragrance.

2. The insert of claim 1 wherein the said composite material is a laminate, the laminate comprising first and second lamina of the said synthetic resin and a third lamina arranged therebetween which contains the said fragrant volatile odor releasing substance.

3. The insert of claim 1 wherein the said composite material contains the said fragrant volatile odor releasing substance distributed throughout the synthetic resin.

4. The insert of claim 1 wherein the said synthetic resin is acrylic resin.

5. The insert of claim 4 wherein the said composite material is a laminate, the laminate comprising first and second lamina of the said synthetic resin and a third lamina arranged therebetween which contains the said fragrant volatile odor releasing substance.

6. The insert of claim 4 wherein the said composite material contains the fragrant volatile odor releasing substance distributed throughout the synthetic resin.

7. The insert of claim 1 wherein the said fragrant volatile odor releasing substance is fragrant volatile essential oil.

8. The insert of claim 1 wherein the said synthetic resin is selected from the group consisting of polyacrylates and polymethacrylates.

9. The insert of claim 1 wherein the said synthetic resin is a resinous polymer of a monomer selected from the group consisting of methyl acrylate and methyl methacrylate.

10. The insert of claim 1 wherein the said synthetic resin is a resinous polymer of methyl acrylate and the said fragrant volatile odor releasing substance is an admixture containing about 50–70% by weight of spearmint oil and 50–30% by weight of citronella.

11. A self-deodorizing and fragrance releasing ash tray comprising an ash tray for receiving refuse from partially and completely combusted combustible tobacco products, the ash tray having a refuse receiving surface which is also useful for extinguishing burning combustible tobacco products, a deodorizing and fragrance releasing insert, the insert being constructed from a deodorizing and fragrance releasing composite material consisting essentially of a major proportion by weight of synthetic resin and an effective but minor proportion by weight of a compatible fragrant volatile odor releasing substance, the insert having the general configuration of said refuse receiving surface and being of size and shape to rest thereon and cover the said refuse receiving surface, the said composite material having sufficient fire resistance to permit burning combustible tobacco products to be extinguished thereon without igniting, the composite material being capable of removing obnoxious odors from burning combustible tobacco products extinguished thereon and from completely and partially combusted combustible tobacco products deposited thereon, and the composite material also being capable under the normal conditions of use of the ash tray of releasing fragrance from said volatile odor releasing substance whereby said obnoxious odors are removed and replaced with a pleasing fragrance.

12. The ash tray of claim 11 wherein the said composite material is a laminate, the laminate comprising first and second lamina of the said synthetic resin and a third lamina arranged therebetween which contains the said fragrant volatile odor releasing substance.

13. The ash tray of claim 11 wherein the said composite material contains the said fragrant volatile odor releasing substance distributed throughout the synthetic resin.

14. The ash tray of claim 11 wherein the said synthetic resin is acrylic resin.

15. The ash tray of claim 14 wherein the said composite material is a laminate, the laminate comprising first and second lamina of the said synthetic resin and a third lamina arranged therebetween which contains the said fragrant volatile odor releasing substance.

16. The ash tray of claim 14 wherein the said composite material contains the fragrant volatile odor releasing substance distributed throughout the synthetic resin.

17. The ash tray of claim 11 wherein the said fragrant volatile odor releasing substance is fragrant volatile essential oil.

18. The ash tray of claim 11 wherein the said synthetic resin is selected from the group consisting of polyacrylates and polymethacrylates.

19. The ash tray of claim 11 wherein the said synthetic resin is a resinous polymer of a monomer selected from the group consisting of methyl acrylate and methyl methacrylate.

20. The ash tray of claim 11 wherein the said synthetic resin is a resinous polymer of methyl acrylate and the said fragrant volatile odor releasing substance is an admixture containing about 50–70% by weight of spearmint oil and 50–30% by weight of citronella.

21. A self-deodorizing and fragrance releasing ash tray comprising an ash tray for receiving refuse from partially and completely combusted combustible tobacco products, the ash tray having a refuse receiving surface which is also useful for extinguishing burning combustible tobacco products, the ash tray including the said refuse receiving surface thereof being constructed from a deodorizing and fragrance releasing composite material consisting essentially of a major proportion by weight of fire resistant synthetic resin and an effective but minor proportion by weight of a compatible fragrant volatile odor releasing substance, the said composite material having sufficient fire resistance to permit burning combustible tobacco products to be extinguished thereon without igniting, the composite material being capable of removing obnoxious odors from burning combustible tobacco products extinguished thereon and from completely and partially combusted combustible tobacco products deposited thereon, and the composite material also being capable under normal conditions of use of the ash tray of releasing fragrance from said fragrant volatile odor releasing substance whereby said obnoxious odors are removed and replaced with a pleasing fragrance.

22. The ash tray of claim 21 wherein the said composite material is a laminate, the laminate comprising first and second lamina of the said synthetic resin and a third lamina arranged therebetween which contains the said fragrant volatile odor releasing substance.

23. The ash tray of claim 21 wherein the said composite material contains the said fragrant volatile odor releasing substance distributed throughout the synthetic resin.

24. The ash tray of claim 21 wherein the said synthetic resin is acrylic resin.

25. The ash tray of claim 24 wherein the said composite material is a laminate, the laminate comprising first and second lamina of the said synthetic resin and a third lamina arranged therebetween which contains the said fragrant volatile odor releasing substance.

26. The ash tray of claim 24 wherein the said composite material contains the fragrant volatile odor releasing substance distributed throughout the synthetic resin.

27. The ash tray of claim 21 wherein the said fragrant volatile odor releasing substance is fragrant volatile essential oil.

28. The ash tray of claim 21 wherein the said synthetic resin is selected from the group consisting of polyacrylates and polymethacrylates.

29. The ash tray of claim 21 wherein the said synthetic resin is a resinous polymer of a monomer selected from the group consisting of methyl acrylate and methyl methacrylate.

30. The ash tray of claim 21 wherein the said synthetic resin is a resinous polymer of methyl acrylate and the said fragrant volatile odor releasing substance is an admixture containing about 50–70% by weight of spearmint oil and 50–30% by weight of citronella.

* * * * *